US007057444B2

(12) United States Patent
Illegems

(10) Patent No.: US 7,057,444 B2
(45) Date of Patent: Jun. 6, 2006

(54) AMPLIFIER WITH ACCURATE BUILT-IN THRESHOLD

(75) Inventor: Paul F. Illegems, Tucson, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 16 days.

(21) Appl. No.: 10/667,535

(22) Filed: Sep. 22, 2003

(65) Prior Publication Data

US 2005/0077954 A1 Apr. 14, 2005

(51) Int. Cl.
*G05F 1/46* (2006.01)

(52) U.S. Cl. ..... 327/541; 327/513; 327/543; 323/316; 330/261

(58) Field of Classification Search ..... 327/108, 327/513, 539, 541, 543, 546; 323/313–316; 330/253, 261

See application file for complete search history.

(56) References Cited

U.S. PATENT DOCUMENTS 5,196,833 A 3/1993 Kemp
5,289,166 A 2/1994 Cohen
5,852,376 A * 12/1998 Kraus ..... 327/143
6,002,276 A * 12/1999 Wu ..... 327/66
6,020,775 A * 2/2000 Chevallier ..... 327/393
6,037,762 A 3/2000 Koelling et al.
6,127,854 A 10/2000 Illegems
6,359,494 B1 * 3/2002 Kanda et al. ..... 327/333
6,445,305 B1 9/2002 Andersson et al.
6,771,117 B1 * 8/2004 Nakai ..... 327/541

* cited by examiner

*Primary Examiner*—Timothy P. Callahan
*Assistant Examiner*—Terry L. Englund
(74) *Attorney, Agent, or Firm*—Meyertons Hood Kivlin Kowert & Goetzel, P.C.; Jeffrey C. Hood

(57) ABSTRACT

Various embodiments of a voltage level detector implemented as an integrated circuit whose trip point is approximately constant over variations in temperature as well as variations in transistor fabrication parameters are disclosed along with a differential amplifier whose input offset voltage is highly immune to said variations. In one embodiment, a voltage generator supplies a composite voltage to the gate of the tail current transistor of the voltage level detector or differential amplifier. The first component of the voltage is approximately equal to the threshold voltage of NMOS transistors comprised in the device over variations in operating temperature as well as variations in transistor fabrication parameters while the second component is approximately constant with respect to said variations. When applied to the gate of the tail current transistor, the first component may turn the transistor on in spite of the above-mentioned parametric variations.

33 Claims, 7 Drawing Sheets

AMPLIFIER WITH ACCURATE BUILT-IN THRESHOLD

BACKGROUND OF THE INVENTION

1. Field of the Invention

This invention relates to integrated circuits, and more particularly, to differential amplifiers implemented as integrated circuits.

2. Description of the Related Art

Differential amplifiers are frequently employed to indicate when an input signal is greater than or equal to a certain value. The amplifier can be configured to change output states from one logic level to another when a voltage signal is applied between the positive and negative inputs of the amplifier. In this configuration the amplifier and associated circuitry are typically referred to as a voltage or level detector.

The voltage level at which the detector will trip (change output states) is typically established by applying a constant reference voltage to the negative input of the amplifier and a variable signal to the positive input. The output of the detector will be at one state until the voltage at the positive input is greater than or equal to the reference voltage. At this point the positive differential voltage at the amplifier input will produce a shift in the amplifiers output state. For example, it may be desired to have an indication of when a signal is greater than or equal to half the supply voltage, Vcc, for a certain system. A voltage divider network in which both resistors have the same value may be used to bias the negative input of the differential amplifier to Vcc/2. Under these circumstances the output of the level detector should change states each time the input voltage passes through the Vcc/2 point. If the output is at logic 0 when the input is less than Vcc/2, then it should change to logic 1 when the input becomes greater than or equal to Vcc/2.

Two such level detector circuits may be combined to produce a window detector. Often it is desirable to produce an indication that an input signal is within a certain window, i.e. that the signal is greater than some minimum voltage level and less than some maximum level. Such a detection circuit may be realized by appropriately combining the outputs of two level detectors, which have been biased for trip points at the minimum and maximum boundary voltage levels. For example, in a personal computer system it may be desired to produce an indication when a power supply voltage exceeds or falls below its nominal value by a certain percentage in order to insure reliable functioning of the system.

Optimally, the amplifier/detector should change states for any positive differential voltage applied between the positive and negative inputs no matter how small. In real world implementations, however, certain physical parameters limit and/or move the trip point of the amplifier. For differential amplifiers implemented in CMOS technology, the trip point may be affected by the threshold voltage of the transistors used to construct the circuit. The transistor threshold voltage may be dependent on fabrication parameters such as doping levels, the dielectric constant of the gate insulating material, and feature geometry among others. While many of these fabrication parameters may be fairly tightly controlled across transistors within a single die, significant variances may occur from die to die or from one wafer to another. This means that the trip point of one detector IC may be somewhat different from the trip point of another IC built to the same design simply due to production process variations.

Another factor that may cause variance in the trip point of a differential amplifier is the temperature at which it operates. The threshold voltage of CMOS transistors is directly dependent on operating temperature and furthermore the dependence for PMOS devices is different than that for NMOS devices.

In typical implementations, the differences in trip point caused by production process variations as well as temperature over the useful range of the circuit may be on the order of a few millivolts. In many applications, the voltage being detected is on the order of several volts, so the trip point accuracy may be within a few tenths of a percent. However, some applications may require the detection of voltage levels on the order of several tens of millivolts. The same process and temperature variations can produce voltage detection errors on the order of 10% in these applications. Therefore, it may be desirable to implement a differential amplifier whose trip point has a high immunity to temperature and fabrication process variations.

SUMMARY

Various embodiments of a voltage level detector implemented as an integrated circuit whose trip point is approximately constant over variations in temperature as well as variations in transistor fabrication parameters are disclosed along with a differential amplifier whose input offset voltage is highly immune to said variations. In one embodiment, a voltage generator supplies a composite voltage to the gate of the tail current transistor of the voltage level detector or differential amplifier. The first component of the voltage is approximately equal to the threshold voltage of NMOS transistors comprised in the device over variations in operating temperature as well as variations in transistor fabrication parameters while the second component is approximately constant with respect to said variations. When applied to the gate of the tail current transistor, the first component may turn the transistor on in spite of the above-mentioned parametric variations.

The second component of the gate voltage may provide the constant effective voltage, Veff, for the tail current transistor and may produce a tail current, It, proportional to beta of the NMOS process according to the relationship: It=(beta/2)*(Veff)^2. The input voltage, Vtr, to the voltage level detector needed to trip the device causing a change in the state of the output may be determined by the relationship: Vtr =C*(It/beta)^½. Since the first relationship shows It to be proportional to beta, substituting k*beta into the second relationship for It yields Vtr to be a function of only constants. Therefore, the trip point of the voltage level detector, and analogously, the input offset voltage of a differential amplifier may be made highly immune to variations in operating temperature as well as variations in transistor fabrication parameters.

The first component of the compound voltage described above may be generated by passing a very small current through specially designed, diode-connected transistor. A diode-connected transistor may operate in saturation mode governed by the equation Vgs=Vt+(Id/beta)^½. By designing the W/L ratio of the transistor to be very large and passing a very small current through it, the second term of the right side of the equation may be made small with respect to the threshold voltage Vt, and under these conditions Vgs may approximate Vt to a very high degree.

The constant component of the composite voltage may be readily derived from a bandgap voltage reference. If the source of the high-beta, diode connected NMOS transistor is coupled to a constant current sink of sufficiently small value, and the gate/drain is coupled to the drain of a PMOS transistor biased to pass at least the current drawn by the current sink, then Vgs of the NMOS transistor may be approximately equal to the threshold voltage for the NMOS process over variations in operating temperature as well as variations in transistor fabrication parameters.

An amplifier may be added to the circuit described above such that its negative input is coupled to the output of a bandgap voltage reference and its positive input is coupled to the node that couples the source of the NMOS transistor to the current sink. The output of the amplifier may be coupled to the gate of the PMOS transistor forming a feedback loop such that the voltage at the source of the NMOS transistor is held at the voltage of the bandgap reference. Under these circumstances, the voltage at the gate/drain of the NMOS transistor may be equal to the sum of the bandgap reference voltage and the threshold voltage for the NMOS process over variations in operating temperature as well as variations in transistor fabrication parameters.

BRIEF DESCRIPTION OF THE DRAWINGS

Other aspects of the invention will become apparent upon reading the following detailed description and upon reference to the accompanying drawings in which.

Figure 1:
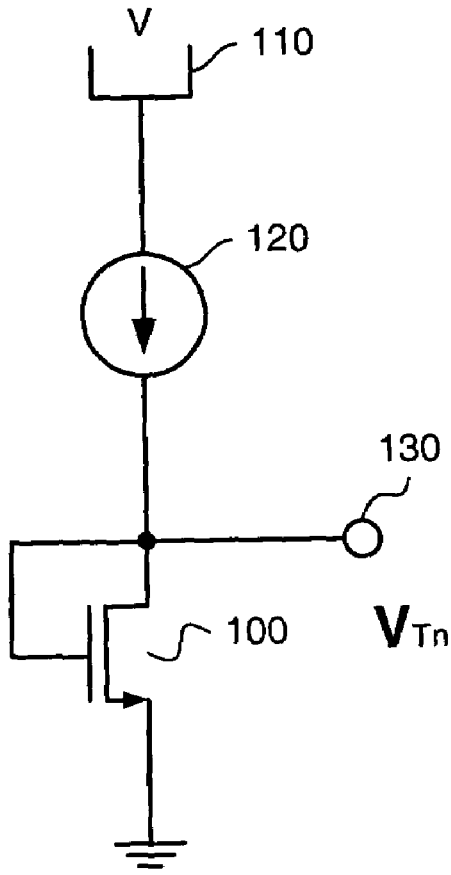
FIG. 1 shows a diagram of a circuit for generating a voltage corresponding to the threshold voltage of a transistor, according to prior art.

While the invention is susceptible to various modifications and alternative forms, specific embodiments thereof are shown by way of example in the drawings and will herein be described in detail. It should be understood, however, that the drawings and description thereto are not intended to limit the invention to the particular form disclosed, but, on the contrary, the invention is to cover all modifications, equivalents, and alternatives falling with the spirit and scope of the present invention as defined by the appended claims.

DETAILED DESCRIPTION OF EMBODIMENTS

FIG. 1 shows a diagram of a prior art circuit for generating a voltage that approximates the threshold voltage of an NMOS transistor. The threshold voltage for an NMOS transistor may be defined as a voltage applied between the gate and source of the transistor that causes the free electron concentration at the gate oxide interface to be equal to the hole concentration in the bulk semiconductor material. In other terms, it is the lowest gate voltage for which appreciable current flows through the channel between the source and the drain.

The transistor threshold voltage may be dependent on a number of fabrication process parameters such as doping or implantation levels, and the dielectric constant and/or thickness of the gate insulating material. While many of these fabrication parameters may be fairly tightly controlled across transistors within a single die, significant variances may occur from die to die or from one wafer to another. This means that the threshold voltage of a transistor in one IC may be somewhat different from the threshold voltage of the corresponding transistor in another IC built to the same design simply due to production process variations.

Another factor that may cause variance in the threshold voltage of a transistor is the temperature at which it operates. The threshold voltage of CMOS transistors may be directly dependent on operating temperature and furthermore the dependence for PMOS devices may be different than that for NMOS devices.

The gate of NMOS transistor 100 of FIG. 1 is tied directly to its drain so that the gate-source voltage will be equal to the drain-source voltage at circuit output 130. For diode-connected NMOS transistor 100, Vds>Vgs−Vt, therefore, the transistor operates in the saturation region and the relationship between current and voltage may be stated as: Id=[u Cox W (Vds−Vt)^2]/2L. Solving this equation for Vds yields: Vds=Vt+(2 Id/beta)^½where beta=u Cox W/L. From this relationship, if the ratio of Id to beta is made small enough, the second term becomes insignificant with respect to Vt, and Vds may closely approximate Vt. For example in FIG. 1, current source 120 may provide 100 nano-Amperes to the drain of NMOS transistor 100 from supply 110. The channel width to length ratio may be 400, and the second term of the equation for Vds may evalute to approximately 5 milli-Volts. If the threshold voltage, Vt, of transistor 100 is on the order of 750 milli-Volts, then Vds as output at node 130 may approximate Vt to within an accuracy of about half of one percent.

It is well known that the voltage drop of a forward biased PN junction varies in a complementary fashion with respect to absolute temperature. For example, in a BJT a change in Vbe relative to a change in absolute temperature may be in the range of −1 to −1.5 millivolts per Kelvin and linear to a first order approximation. This relationship may be referred to as complementary to absolute temperature (CTAT). On the other hand, the difference in the value of base-emitter voltage for a transistor operating at a first base-emitter current density, J1, versus the value of Vbe when the transistor is operated at a second base-emitter current density, J2, may be directly proportional to absolute temperature (PTAT). Further, the difference in base-emitter voltages of two transistors operating at different base-emitter current densities may be linearly PTAT.

Figure 2:
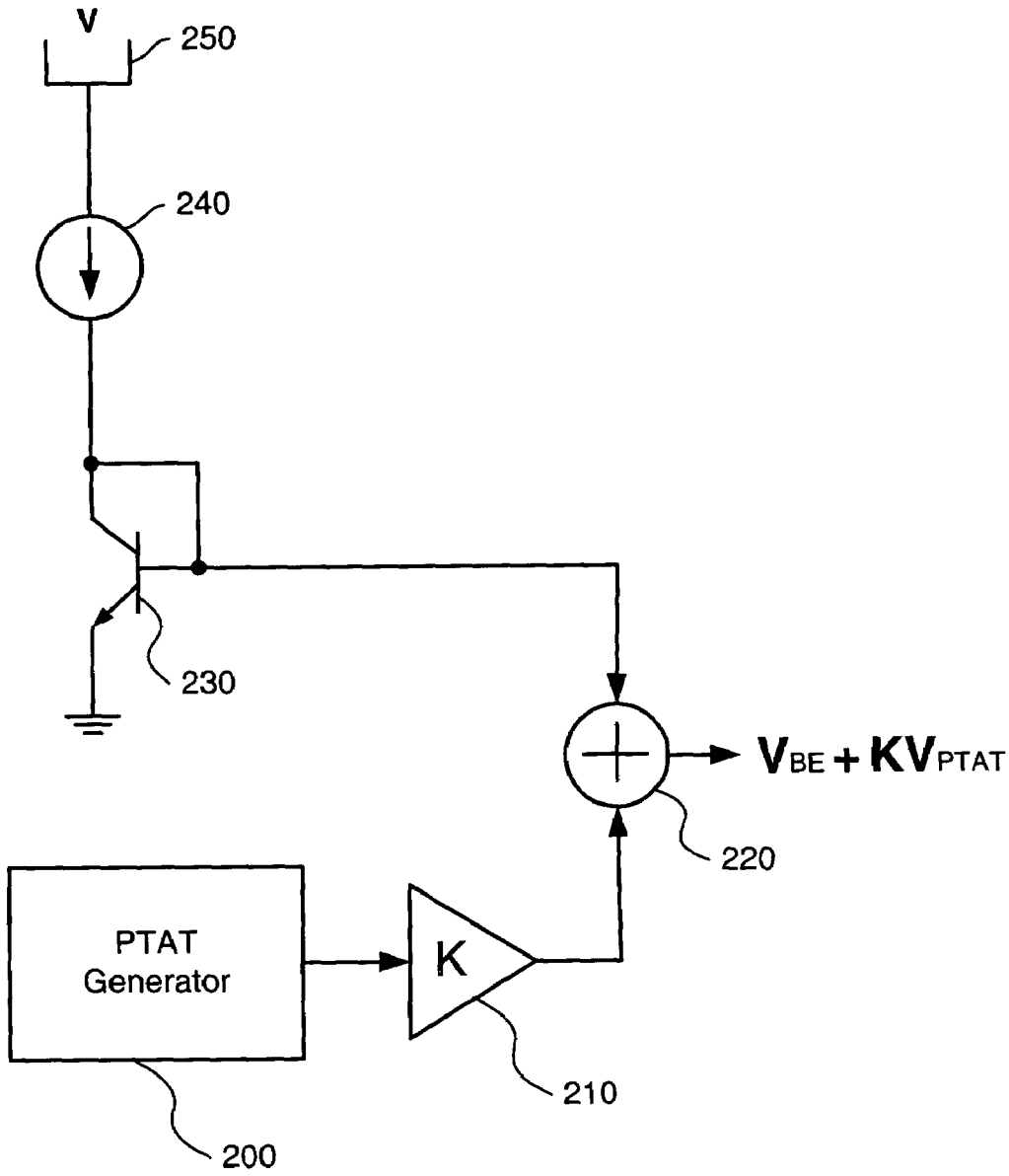
FIG. 2 shows the architecture of a bandgap voltage reference according to prior art.

FIG. 2 illustrates an architecture for a voltage reference that is constant with respect to variations in temperature. Transistor 230 is connected as a diode such that Vce is equal to Vbe. Ideal current source 240 supplies bias current to diode 230 from supply 250. Since, as described above, the base-emitter voltage of transistor 230 is nearly linearly CTAT, it may be possible to combine this voltage at summing node 220 with a linear PTAT signal produced by generator 200 appropriately scaled by 210 such that the output of the summation node is a voltage that is very nearly constant with respect to variations in temperature.

Figure 3:
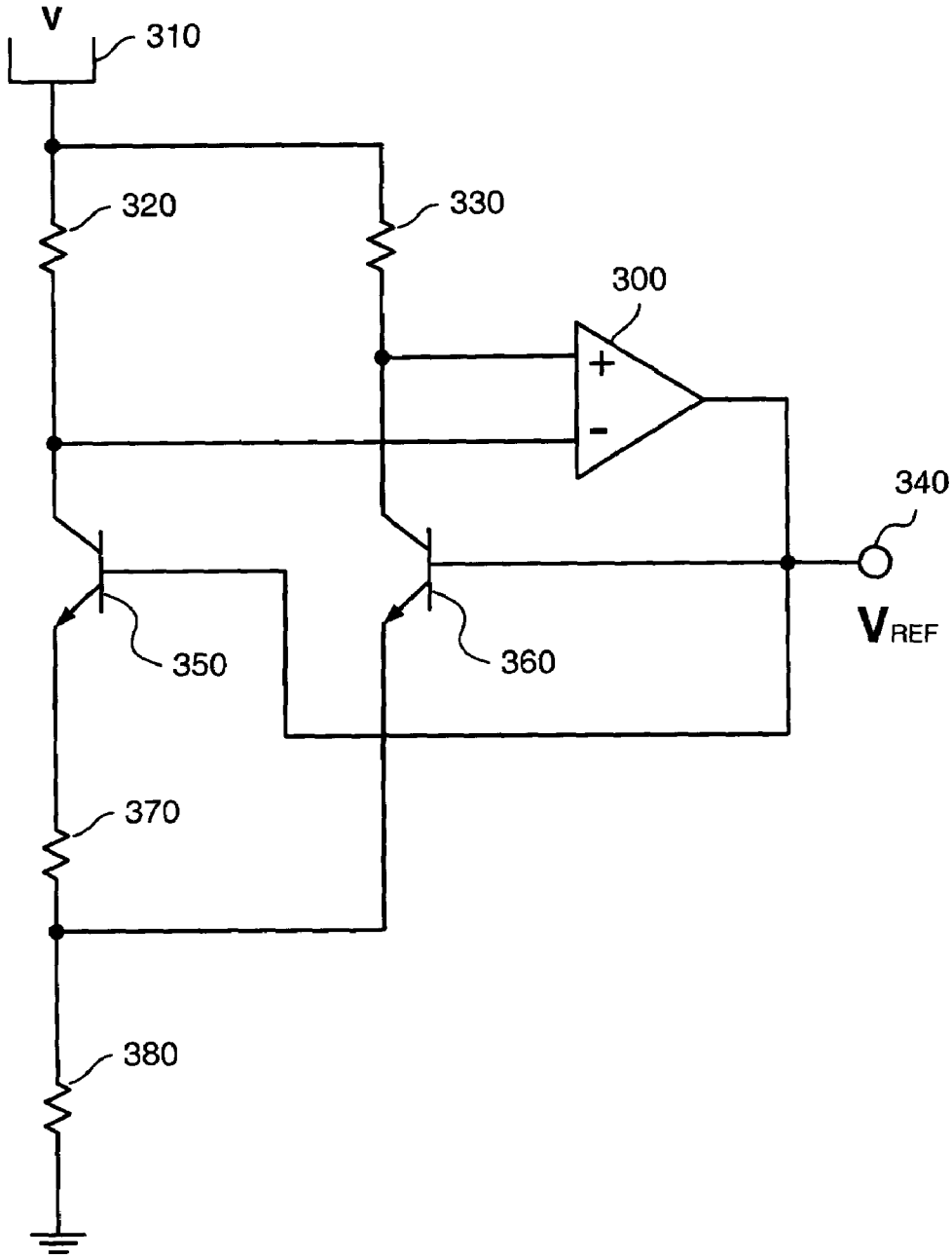
FIG. 3 is a diagram of a Brokaw bandgap voltage reference according to prior art.

FIG. 3 shows a circuit attributed to Brokaw that is typically used to implement such a temperature immune voltage reference. Supply 310 provides bias current for both legs through resistors 320 and 330 as well as power to comparator/amplifier 300. Amplifier 300 establishes a feedback loop to force the same voltage level at the collectors of transistors 350 and 360. By setting the values of resistors 320 and 330 equal to one another, the current in both transistor legs of the circuit is forced to be equal by the action of the amplifier. By fabricating the base-emitter area of transistor 350 to be a multiple of the base-emitter area of transistor 360, the base-emitter current densities for the two transistors are forced to differ by this ratio. This difference in current density generates a difference in the base-emitter voltages of transistors 350 and 360, which appears as the voltage across resistor 370. This PTAT voltage is multiplied by a constant, which includes the ratio of resistors 380 and 370 to generate the required positive temperature dependence to compensate for the negative temperature dependence of the base-emitter voltage of transistor 360. The bandgap reference voltage then is the sum of the PTAT voltage across resistor 380 and the CTAT base-emitter voltage of transistor 360. Circuits of this type are capable of producing reference voltages that remain constant within a few millivolts over an operational temperature range of more than 100 degrees C.

Figure 4:
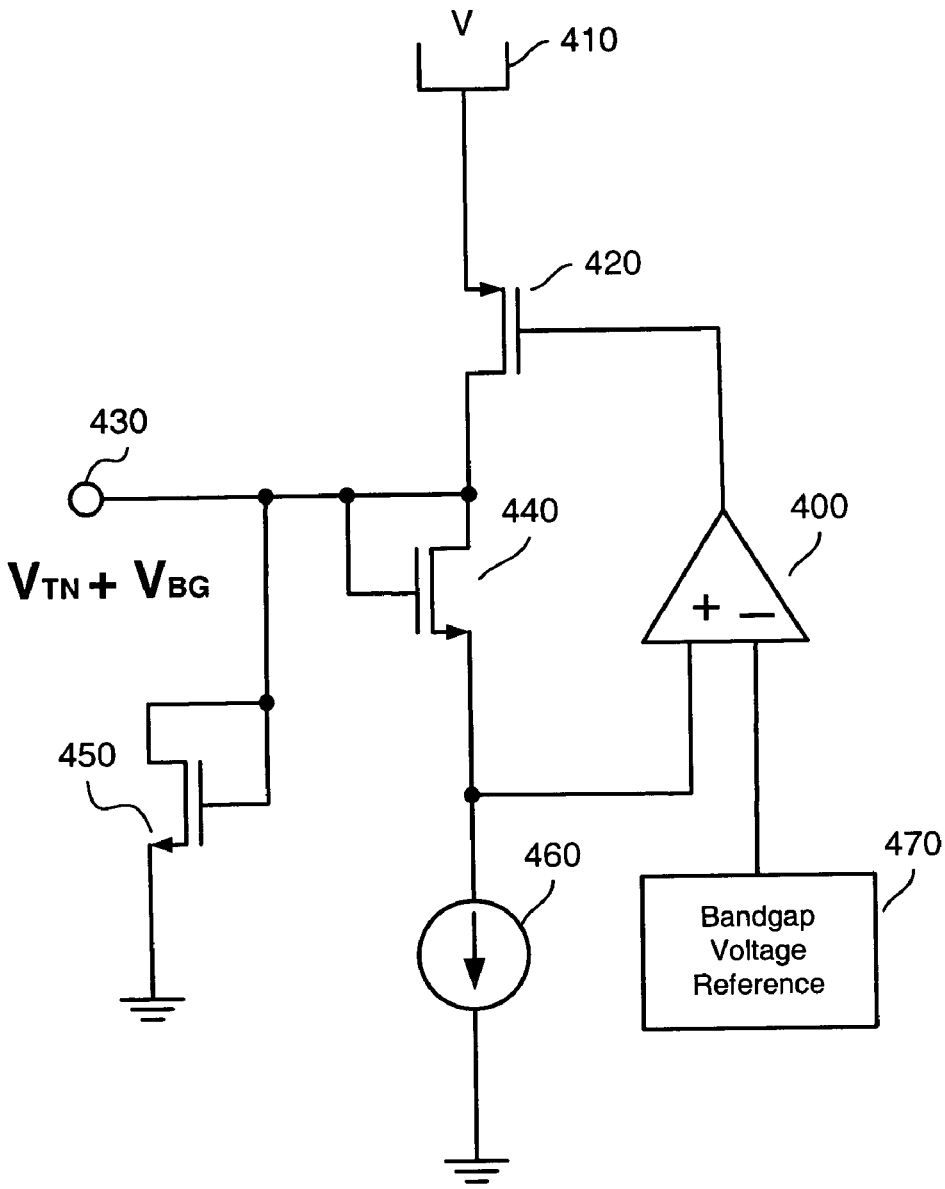
FIG. 4 shows a diagram of a circuit for generating a voltage corresponding to the sum of the threshold voltage of a transistor and reference voltage, according to one embodiment.

FIG. 4 illustrates a circuit for producing a current with both constant and dependent components, according to one embodiment. Current source 460 may be set to draw a small current through NMOS transistor 440 as was described in association with FIG. 1. In this configuration the gate-source voltage of NMOS transistor 440 may closely match the threshold voltage of the NMOS for a range of fabrication process parameters and temperature. Current is supplied to NMOS transistor 440 from voltage source 410 through PMOS transistor 420. Since only a negligible amount of current may flow in the channel of an NMOS transistor whose gate-source bias is at or below the threshold voltage, it may be desirable to generate a voltage that has one component that follows the NMOS threshold voltage over process and temperature variations, and another component that is independent of such variations.

Bandgap voltage reference 470 may be of the type described in detail with regard to FIG. 3. The provided reference voltage may remain constant to within a few millivolts with respect to variations in production process parameters as well as temperature over an operational range in excess of 100 degrees C. For example, a bandgap reference with an output of 1.25V may vary by less than 5 millivolts over a temperature range of −25 to +100 degrees C. corresponding to an error of less than one half of one percent.

By applying the bandgap reference voltage to the negative input of amplifier 400 and connecting the source of NMOS transistor 440 to the positive input, the output of the amplifier may be tied to the gate of PMOS transistor 420 and used to control the voltage levels at the terminals of the NMOS transistor. Any time the positive input of the amplifier falls below the negative input, the amplifier generates an output voltage that may reduce the gate potential of PMOS transistor 420. This may have the effect of increasing the voltage level at the drain of NMOS transistor 440 (output 430) and, in turn, the voltage level at the source of NMOS transistor 440. This may raise the voltage level at the negative input of amplifier 400 until it is equal to that of bandgap voltage reference 470. Thus, the action of the feedback loop including differential amplifier 400 and bandgap voltage reference 470 may force the voltage level at the source of NMOS transistor 440 to match the reference voltage, Vbg.

The voltage at node 430 may be the voltage at the source of NMOS transistor 440, Vbg, plus the gate-source voltage of NMOS transistor 440. As was described in detail with regard to FIG. 1, the fact that current sink 460 pulls a very small current through NMOS transistor 440 may cause the gate-source voltage of the transistor to match the threshold voltage for the NMOS, Vtn. The output voltage at node 430 may then be equal to the constant bandgap reference voltage with a variable Vtn added to it. By applying the voltage at node 430 to another NMOS transistor 450, a channel current may be obtained that varies inversely with respect to changes in production process parameters as well as operating temperature. The variable voltage component Vtn may keep the NMOS transistor 450 biased at the threshold level despite changes in the above-mentioned variables while the constant voltage component Vbg provides the effective voltage to produce a drain-source current proportional to beta for the NMOS 450.

Figure 5:
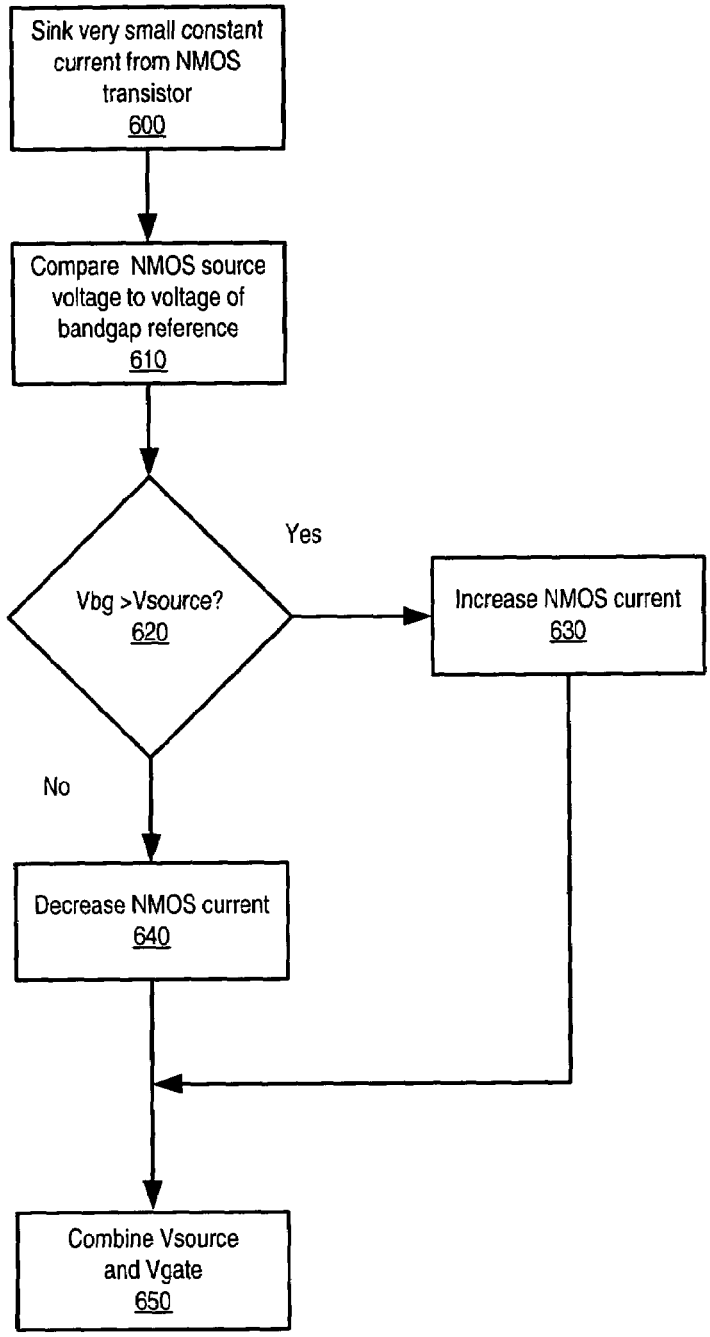
FIG. 5 is a flowchart of a method of operating an integrated circuit, according to one embodiment.

FIG. 5 is a flow chart of a method for operating an IC to generate a voltage that is the sum of a voltage that approximates the threshold voltage, Vtn, of NMOS transistors over a range of production process parameter and temperature variations, added to a voltage that is constant with respect to the previously mentioned variations, according to one embodiment. As depicted at block 600, a constant current sink may be set to a very small value with respect to the beta of an NMOS transistor of a given geometry fabricated on an IC with given process parameters. The constant current sink may be coupled to the source of an NMOS transistor whose drain and gate are connected. If the input to the drain-gate of the NMOS transistor is not restricted and the voltage at this point is allowed to vary, then gate-source voltage for this transistor may closely approximate the NMOS threshold voltage, Vtn, over variations in temperature and fabrication process parameters.

The source of the NMOS transistor may be compared to a constant voltage level as shown in block 610. The constant voltage level may be obtained from the output of a bandgap voltage reference as described previously. The comparison function may be performed by a differential amplifier. The voltage at the source of the NMOS transistor may be coupled to the positive input of the amplifier, while the output of a bandgap voltage reference may be coupled to the negative amplifier input. The output of the amplifier may be used as in a feedback loop to force the voltage at the source of the NMOS transistor to remain constant at the level of the output of the bandgap voltage reference.

As illustrated in decision block 620, if the voltage at the source of the NMOS transistor should fall below that of the bandgap reference, the amplifier may generate a signal to increase the current through the transistor, thereby raising the voltage at the source, as shown at block 630. One the other hand, if the voltage at the source of the NMOS transistor should rise above that of the bandgap reference, the amplifier may generate a signal to decrease the current through the transistor, thereby lowering the voltage at the source, as shown at block 640. The net effect of this feedback loop may be to cause the voltage at the source of the NMOS transistor to track the output of the voltage reference through variations in temperature and production parameters.

Because the voltage at the source of the NMOS transistor is constant, the voltage at the gate-drain may be the sum, as indicated at 650, of the constant voltage added to the variable threshold voltage, Vtn, which is dependent on temperature as well as variations in IC production parameters. This voltage may be useful for biasing other devices as detailed below.

Figure 6:
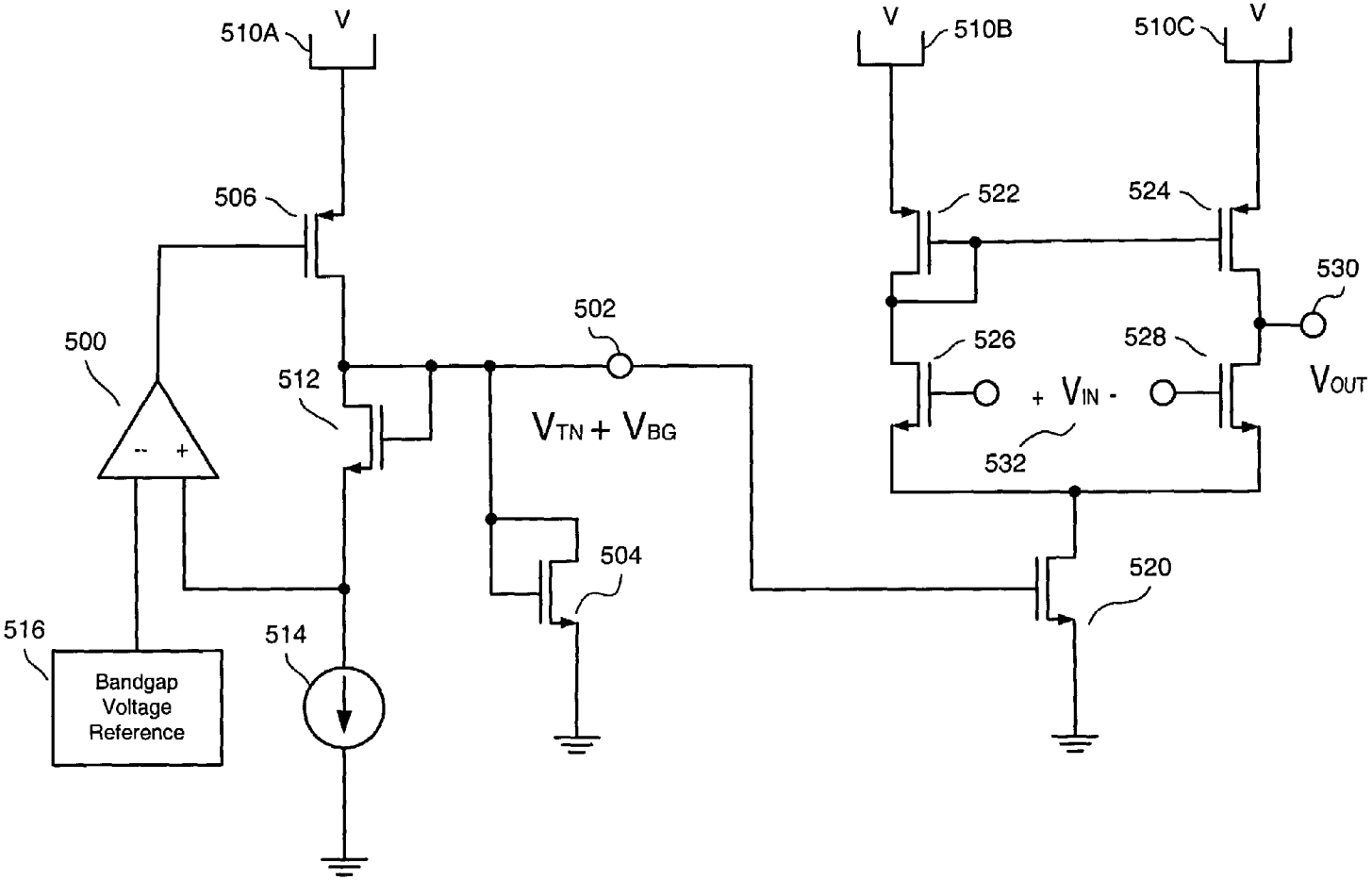
FIG. 6 illustrates a voltage detector whose trip point is highly immune to variations in production processes and temperature, according to one embodiment.

FIG. 6 illustrates a voltage detector whose trip point may be highly immune to variations in production processes and temperature, according to one embodiment. Voltage supply 510 may provide current through PMOS 522 and positive input NMOS 526 for one leg of the detector/amplifier and through PMOS 524 and negative input NMOS 528 for the other leg. The currents through the two legs may combine to form the tail current for the amplifier as established by NMOS 520. PMOS transistors 522 and 524 may have the same channel width to length geometries, while NMOS 528 may have a width N times that of NMOS 526. The ratio of the geometries of NMOS 526 and 528 may be a determining factor in establishing the trip point for the amplifier. For example, at the trip point the currents through the legs of the amplifier may be equal. Since the sum of the leg currents may combine to form the tail current, It, through NMOS 520, the current through each leg may be It/2. Summing the gate-source voltages for NMOS transistors 526 and 528 yields: Vin 532 (at the trip point) equals Vt plus sqrt(It/beta) minus Vt minus sqrt(It/Nbeta). After simplification the expression for the amplifier input voltage at the trip point may become: Vtp equals (1−1/sqrt(N)) sqrt(It/beta). Therefore, if a tail current, It, were sunk through NMOS 520 such that It/beta were constant with respect to process parameter and temperature variations, then the trip point of the detector/amplifier might also be constant with respect to those variations.

Bandgap voltage reference 516, amplifier 500, PMOS 506, and current sink 514 form a feedback network that may keep NMOS transistor 512 biased such that its gate-source voltage is equal to the NMOS threshold voltage, Vtn, over variations in fabrication process parameters and temperature. Since amplifier 500 forces the source of NMOS transistor 512 to be at the same potential as the bandgap voltage reference, the voltage at node 502 may be the sum of the constant bandgap voltage added to the variable NMOS threshold voltage Vtn. This voltage is applied to the connected gate and drain of NMOS transistor 504 whose source is grounded. The Vtn portion of the node 502 voltage may bias transistor 504 to the threshold level over variations in process parameters and temperature, but may not produce significant channel current. The Vbg portion of the signal may produce a drain-source current in transistor 504 proportional to its beta according to the relationship Ids equals (beta/2)(Vgs−Vtn)^2, since NMOS 504 operates in saturation mode.

A current mirror may be formed by PMOS transistor 506, NMOS transistor 504, and NMOS transistor 520. Therefore, the current through NMOS transistor 504 may be mirrored through NMOS transistor 520. Changes in the channel geometry, W/L ratio, of transistor 520 relative to transistor 504 may change the ratio of the currents flowing through these two transistors by a proportionality constant k. But since the current through transistor 504 is proportional to the NMOS process beta, the current through transistor 520 will likewise be proportional to beta.

As was shown previously, the drain-source current through NMOS transistor 520 is the tail current for the voltage detector whose input differential pair includes transistors 526 and 528. It was shown that the input voltage 532 at which the detector will trip is Vtp equals (1−1/sqrt(N)) sqrt(It/beta). If k*beta is substituted for the value of the tail current through transistor 520, the expression for Vtp may include only constants and therefore the voltage at which the detector/amplifier trips may be highly independent of variations in process parameters as well as temperature for an operational range.

Note that the above characterization may apply equally as well to a differential amplifier stage whose input offset voltage may be stabilized with respect to variations in production processes and temperature by using the described device/method to generate the tail current for the differential amplifier stage.

Figure 7:
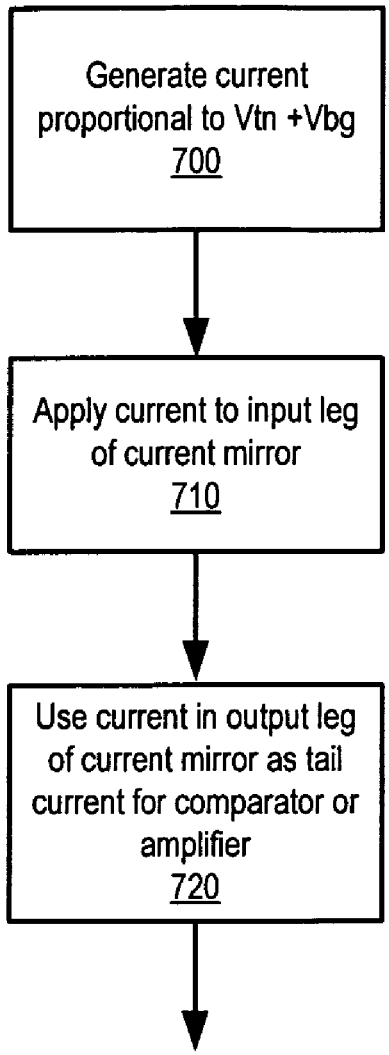
FIG. 7 is a flow chart of a method for operating a comparator/voltage level detector or amplifier implemented as an integrated circuit, according to one embodiment.

FIG. 7 is a flow chart of a method for operating a comparator/voltage level detector or differential amplifier implemented as an integrated circuit, according to one embodiment. At 700, a voltage that is the sum of a voltage that approximates the threshold voltage, Vtn, of NMOS transistors over a range of production process parameter and temperature variations, added to a voltage that is constant with respect to the previously mentioned variations is used to generate a current that is proportional to the voltage sum. As indicated at block 710, this current may be generated in the input leg of a current mirror circuit such that a proportional current may flow in the output leg of the mirror. Block 720 illustrates the use of the current in the output leg of the current mirror as the tail current of a comparator/voltage level detector. By applying the current derived from the sum of the threshold and reference voltages in this fashion, the trip voltage of the comparator/voltage level detector may be constant over a range of production process parameter and temperature variations.

Numerous variations and modifications will become apparent to those skilled in the art once the above disclosure is fully appreciated. It is intended that the following claims be interpreted to embrace all such variations and modifications.

What is claimed is:

1. A method comprising:

generating a constant reference voltage;

generating a threshold voltage component, wherein the threshold voltage component approximates a threshold voltage of an NMOS process over variations in operating temperature and/or variations in transistor fabrication parameters;

generating a composite voltage that is a sum of the constant reference voltage and the threshold voltage component; and applying the composite voltage to a gate of a tail current transistor of a differential input stage, thereby producing an offset voltage of the differential input stage that is substantially independent of the operating temperature and/or the variations in transistor fabrication parameters;

wherein the offset voltage of the differential input stage is proportional to the constant reference voltage.

2. The method of claim 1, wherein the threshold voltage component of the composite voltage turns on the tail current transistor despite the variations in operating temperature and/or the variations in transistor fabrication parameters.

3. The method of claim 2, wherein the constant reference voltage component of the composite voltage produces a tail current for the differential input stage that is proportional to a beta for the NMOS process.

4. The method of claim 1, wherein the differential input stage is comprised in one of:

a differential amplifier; and a voltage level detector.

5. The method of claim 1, wherein the offset voltage remains substantially constant despite the variations in operating temperature and/or the variations in transistor fabrication parameters.

6. A device comprising:

a voltage level detector comprising an NMOS tail current transistor;

a voltage generator configured to deliver a voltage to a gate of the tail current transistor; and a differential pair of NMOS transistors whose sources are configured to couple to a drain of the tail current transistor, wherein a channel-width-to-length ratio of a first one of the differential pair of NMOS transistors differs from a channel-width-to-length ratio of a second one of the differential pair of NMOS transistors;

wherein a first component of the voltage is approximately equal to a threshold voltage (Vt) of NMOS transistors comprised in the device; and wherein a second component of the voltage is approximately constant with respect to variations in operating temperature and/or variations in transistor fabrication parameters.

7. The device of claim 6, wherein the voltage generator comprises a diode-connected transistor and a constant current sink configured to produce the first component of the voltage;

wherein a source of the diode-connected transistor is configured to couple to an input of the constant current sink;

wherein an output of the constant current sink is configured to couple to a negative supply;

wherein a configuration of channel-width-to-length ratio (W/L) of the diode-connected transistor, in conjunction with a current (I) drawn by the constant current sink, satisfies (I/beta)^2<<Vt; and wherein the first component of the voltage is produced as a gate-source voltage of the diode-connected transistor.

8. The device of claim 7, wherein the voltage generator further comprises a bandgap voltage reference having an output configured as the second component of the voltage.

9. The device of claim 8, wherein the voltage generator further comprises an amplifier and a PMOS transistor configured to produce a sum of the first and second components of the voltage at a gate of the diode-connected transistor;

wherein an output of the bandgap voltage reference is configured to couple to an inverting (negative) input of the amplifier;

wherein the source of the diode-connected transistor is configured to couple to the non-inverting (positive) input of the amplifier;

wherein an output of the amplifier is configured to couple to a gate of the PMOS transistor;

wherein a drain of the PMOS transistor is configured to couple to the gate and drain of the diode-connected transistor; and wherein a source of the PMOS transistor is configured to couple to a positive supply.

10. The device of claim 6, wherein the first component of the voltage provides a minimum voltage required to turn on the tail current transistor, substantially unaffected by the variations in operating temperature and/or the variations in transistor fabrication parameters.

11. The device of claim 6, wherein the second component of the voltage provides a constant effective voltage (Veff) for the tail current transistor, a tail current transistor thereby producing the tail current (It) proportional to an NMOS process beta parameter according to: It=(beta/2)*(Veff)^2.

12. The device of claim 6, wherein a trip point of the voltage level detector is substantially constant despite the variations in operating temperature as well as the variations in transistor fabrication parameters.

13. A device comprising:

a differential amplifier comprising an NMOS tail current transistor; and a voltage generator configured to deliver a voltage to a gate of the tail current transistor, the voltage generator comprising:

a constant current sink having an output configured to couple to a negative supply; and a diode-connected transistor having a source configured to couple to an input of the constant current sink;

wherein the constant current sink and the diode-connected transistor are configured to produce a first component of the voltage as a gate-source voltage of the diode-connected transistor;

wherein a configuration of channel-width-to-length ratio (W/L) of the diode-connected transistor, in conjunction with a current (I) drawn by the constant current sink, satisfies (I/beta)^2<<Vt;

wherein the first component of the voltage is approximately equal to a threshold voltage (Vt) of NMOS transistors comprised in the device over variations in operating temperature as well as variations in transistor fabrication parameters; and wherein a second component of the voltage is approximately constant with respect to the variations in operating temperature and/or the variations in transistor fabrication parameters.

14. The device of claim 13, wherein the voltage generator further comprises a bandgap voltage reference configured to produce the second component of the voltage as its output.

15. The device of claim 14, wherein the voltage generator further comprises an amplifier and a PMOS transistor configured to produce a sum of the first and second components of the voltage at a gate of the diode-connected transistor;

wherein an output of the bandgap voltage reference is configured to couple to a negative (inverting) input of the amplifier;

wherein the source of the diode-connected transistor is configured to couple to the positive (non-inverting) input of the amplifier;

wherein an output of the amplifier is configured to couple to a gate of the PMOS transistor;

wherein a drain of the PMOS transistor is configured to couple to the gate and drain of the diode-connected transistor; and wherein a source of the PMOS transistor is configured to couple to a positive supply.

16. The device of claim 13, wherein the first component of the voltage provides a minimum voltage required to turn on the tail current transistor, substantially unaffected by the variations in operating temperature and/or the variations in transistor fabrication parameters.

17. The device of claim 13, wherein the second component of the voltage provides a constant effective voltage (Veff), for the tail current transistor, the tail current transistor thereby producing a tail current (It), proportional to an NMOS process beta parameter according to: It=(beta/2)*(Veff)^2.

18. The device of claim 13, wherein an offset voltage of the differential amplifier is substantially unaffected by the variations in operating temperature and/or the variations in transistor fabrication parameters, thereby remaining substantially constant.

19. A device comprising:

a voltage level detector comprising an NMOS tail current transistor; and a voltage generator configured to deliver a voltage to a gate of the tail current transistor, the voltage generator comprising:

a constant current sink having an output configured to couple to a negative supply; and a diode-connected transistor having a source configured to couple to an input of the constant current sink;

wherein the constant current sink and the diode-connected transistor are configured to produce a first component of the voltage as a gate-source voltage of the diode-connected transistor;

wherein a configuration of channel-width-to-length ratio (W/L) of the diode-connected transistor, in conjunction with a current (I) drawn by the constant current sink, satisfies (I/beta)ˆ2<<Vt; and wherein the first component of the voltage is approximately equal to a threshold voltage (Vt) of NMOS transistors comprised in the device; and wherein a second component of the voltage is approximately constant with respect to variations in operating temperature and/or variations in transistor fabrication parameters.

20. The device of claim 19, wherein the voltage generator further comprises a bandgap voltage reference configured to produce the second component of the voltage as its output.

21. The device of claim 20, wherein the voltage generator further comprises an amplifier and a PMOS transistor configured to produce a sum of the first and second components of the voltage at a gate of the diode-connected transistor;

wherein an output of the bandgap voltage reference is configured to couple to an inverting (negative) input of the amplifier;

wherein the source of the diode-connected transistor is configured to couple to the non-inverting (positive) input of the amplifier;

wherein an output of the amplifier is configured to couple to a gate of the PMOS transistor;

wherein a drain of the PMOS transistor is configured to couple to the gate and drain of the diode-connected transistor; and wherein a source of the PMOS transistor is configured to couple to a positive supply.

22. The device of claim 19, wherein the first component of the voltage provides a minimum voltage required to turn on the tail current transistor, substantially unaffected by the variations in operating temperature and/or the variations in transistor fabrication parameters.

23. The device of claim 19, wherein the second component of the voltage provides a constant effective voltage (Veff) for the tail current transistor, the tail current transistor thereby producing a tail current (It) proportional to an NMOS process beta parameter according to: It=(beta/2)*(Veff)ˆ2.

24. The device of claim 19, further comprising a differential pair of NMOS transistors whose sources are coupled to a drain of the tail current transistor, wherein a channel-width-to-length ratio of a first one of the differential pair of NMOS transistors differs from a channel-width-to-length ratio of a second one of the differential pair of NMOS transistors.

25. The device of claim 19, wherein a trip point of the voltage level detector is substantially constant despite the variations in operating temperature and/or the variations in transistor fabrication parameters.

26. A device comprising:

a voltage level detector comprising an NMOS tail current transistor; and a voltage generator configured to deliver a voltage to a gate of the tail current transistor;

wherein a first component of the voltage is approximately equal to a threshold voltage (Vt) of NMOS transistors comprised in the device; and wherein a second component of the voltage is approximately constant with respect to variations in operating temperature and/or variations in transistor fabrication parameters; and wherein the second component of the voltage provides a constant effective voltage (Veff) for the tail current transistor, the tail current transistor thereby producing a tail current (It) proportional to an NMOS process beta parameter according to: It=(beta/2)*(Veff)ˆ2.

27. The device of claim 26, wherein a trip point of the voltage level detector is substantially constant despite the variations in the operating temperature and/or the variations in transistor fabrication parameters.

28. The device of claim 26, wherein the first component of the voltage provides a minimum voltage required to turn on the tail current transistor, substantially unaffected by the variations in operating temperature and/or the variations in transistor fabrication parameters.

29. A device comprising:

a differential amplifier comprising an NMOS tail current transistor; and a voltage generator coupled to a gate of the tail current transistor;

wherein the voltage generator is configured to deliver a voltage to the gate of the tail current transistor;

wherein a first component of the voltage is approximately equal to a threshold voltage (Vt) of NMOS transistors comprised in the device over variations in operating temperature as well as the variations in transistor fabrication parameters;

wherein a second component of the voltage is approximately constant with respect to the variations in operating temperature and/or variations in transistor fabrication parameters; and wherein the second component of the voltage provides a constant effective voltage (Veff), for a tail current transistor, the tail current transistor thereby producing the tail current (It), proportional to an NMOS process beta parameter according to: It=(beta/2)*(Veff)ˆ2.

30. The device of claim 29, wherein the first component of the voltage provides a minimum voltage required to turn on the tail current transistor, substantially unaffected by the variations in operating temperature and/or the variations in transistor fabrication parameters.

31. The device of claim 29, wherein an offset voltage of the differential amplifier is substantially unaffected by the variations in operating temperature and/or the variations in transistor fabrication parameters, thereby remaining substantially constant.

32. The device of claim 29, wherein the voltage generator comprises:

a constant current sink having an output configured to couple to a negative supply;

a diode-connected NMOS transistor having a source configured to couple to an input of the constant current sink; and a bandgap voltage reference configured to produce the second component of the voltage as its output;

wherein the constant current sink and the diode-connected NMOS transistor are configured to produce the first component of the voltage as gate-source voltage of the diode-connected transistor; and wherein a configuration of channel-width-to-length ratio (W/L) of the diode-connected transistor, in conjunction with a current (I) drawn by the constant current sink, satisfies (I/beta)^2<<Vt.

33. The device of claim 32, wherein the voltage generator further comprises an amplifier and a PMOS transistor configured to produce a sum of the first and second components of the voltage at a gate of the diode-connected transistor;

wherein an output of the bandgap voltage reference is configured to couple to a negative (inverting) input of the amplifier;

wherein the source of the diode-connected transistor is configured to couple to the positive (non-inverting) input of the amplifier;

wherein an output of the amplifier is configured to couple to a gate of the PMOS transistor;

wherein a drain of the PMOS transistor is configured to couple to the gate and drain of the diode-connected transistor; and wherein a source of the PMOS transistor is configured to couple to a positive supply.

* * * * *